US005446987A

United States Patent [19]

Lee et al.

[11] Patent Number: 5,446,987

[45] Date of Patent: Sep. 5, 1995

[54] MUZZLE-LOADED EXPANDING PROJECTILES FOR FIREARMS; KITS FOR MANUALLY PRODUCING EXPANDING PROJECTILE FOR MUZZLE-LOADED FIREARMS; AND METHOD FOR PRODUCING EXPANDING MUZZLE-LOADED PROJECTILES

[75] Inventors: Robert S. Lee, Milo; C. Edward Bottomley, Brownville, both of Me.

[73] Assignee: Ox-Yoke Originals, Inc., Milo, Me.

[21] Appl. No.: 332,105

[22] Filed: Oct. 31, 1994

[51] Int. Cl.[6] ..... F41C 3/14; F41A 35/00; F42B 30/02

[52] U.S. Cl. ..... 42/61; 42/90; 86/43

[58] Field of Search ..... 29/1.11; 42/51, 61, 42/90, 95; 86/1.1, 43

[56] References Cited

U.S. PATENT DOCUMENTS

| | | | |
|---|---|---|---|
| 219,840 | 9/1879 | Winchester | 29/1.22 |
| 703,288 | 6/1902 | Millan . | |
| 1,031,221 | 7/1912 | Wilson | 86/43 |
| 1,665,988 | 4/1928 | Smith | 306/30 |
| 3,154,192 | 10/1964 | Cowley | 206/379 |
| 3,367,483 | 2/1968 | Studen | 206/483 |
| 3,783,445 | 1/1974 | Sefried, II | 42/61 |
| 4,193,348 | 3/1980 | Halverson | 102/509 |
| 4,207,698 | 6/1980 | Burson | 42/90 |
| 4,610,061 | 9/1986 | Halverson | 29/1.23 |
| 5,127,179 | 7/1992 | Marsh | 42/90 |

*Primary Examiner*—Stephen C. Bentley
*Assistant Examiner*—Theresa M. Wesson
*Attorney, Agent, or Firm*—Samuel Meerkreebs

[57] ABSTRACT

A system modified so that an axial ram rod, centering jag and configuring die can be used to simultaneously tamp or size a projectile while forming the projectile into a hollow-nose type which mushrooms when configuring a spherical or double-ogival projectile into the mushrooming-type; and a kit comprising a case and sealing lid enabling a user in the field to optionally select a centering jag conforming to the caliber of the weapon being loaded, and for optionally forming a hollow-nose projectile with a "punch" characteristic in accordance with the nature of the target.

39 Claims, 4 Drawing Sheets

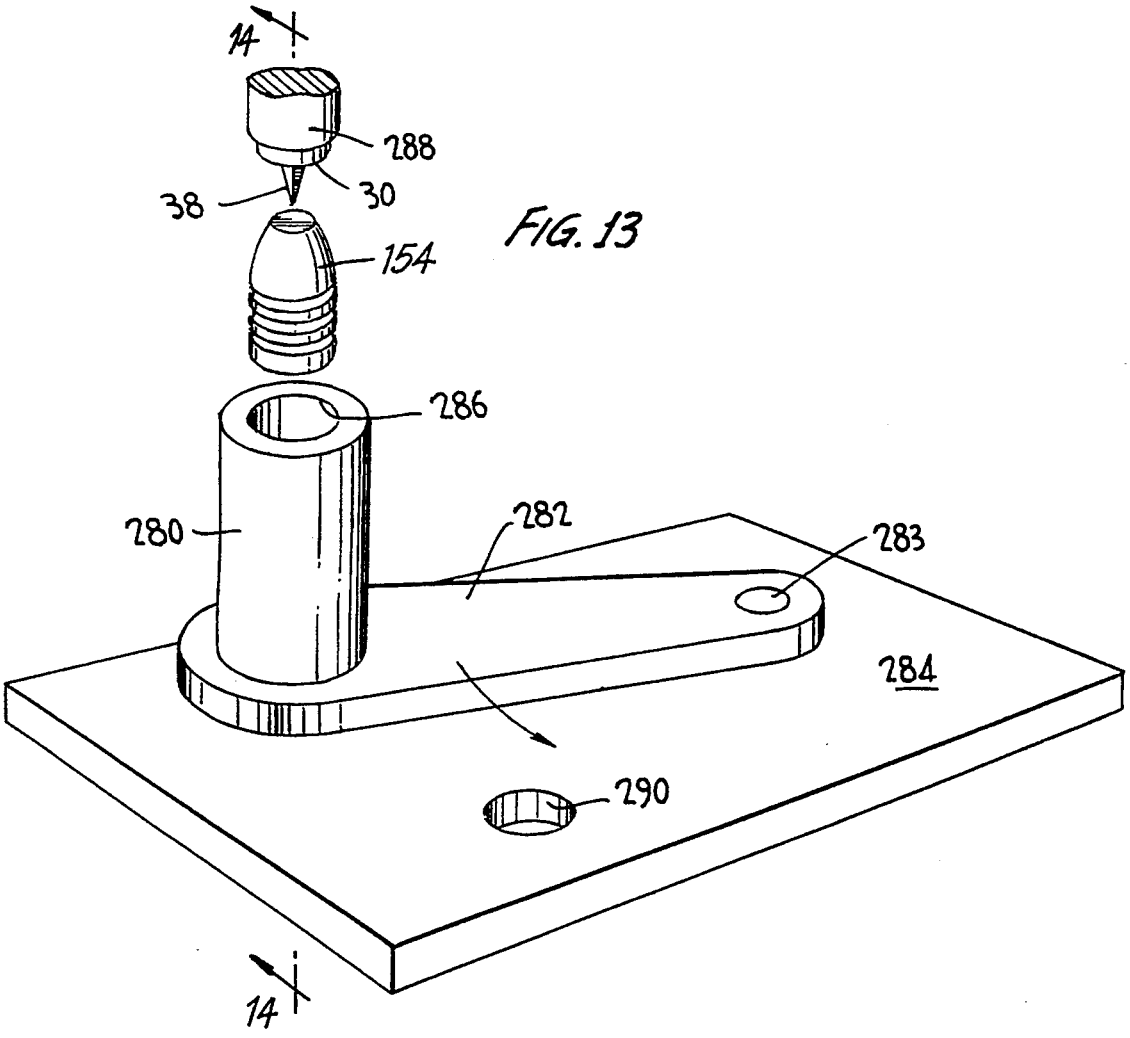
FIG. 13
FIG. 14
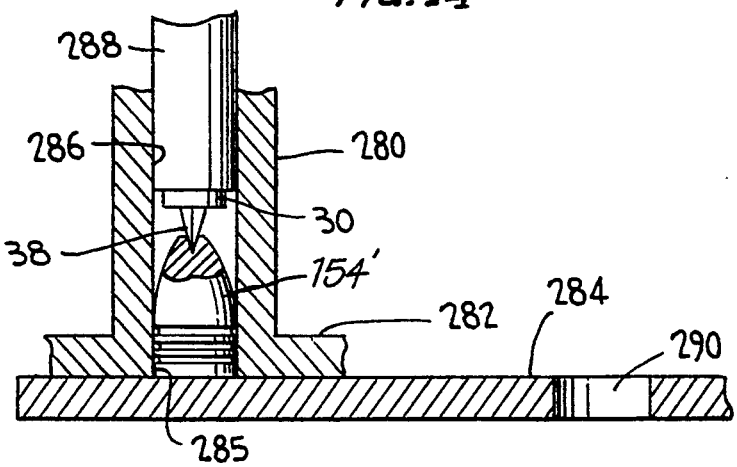

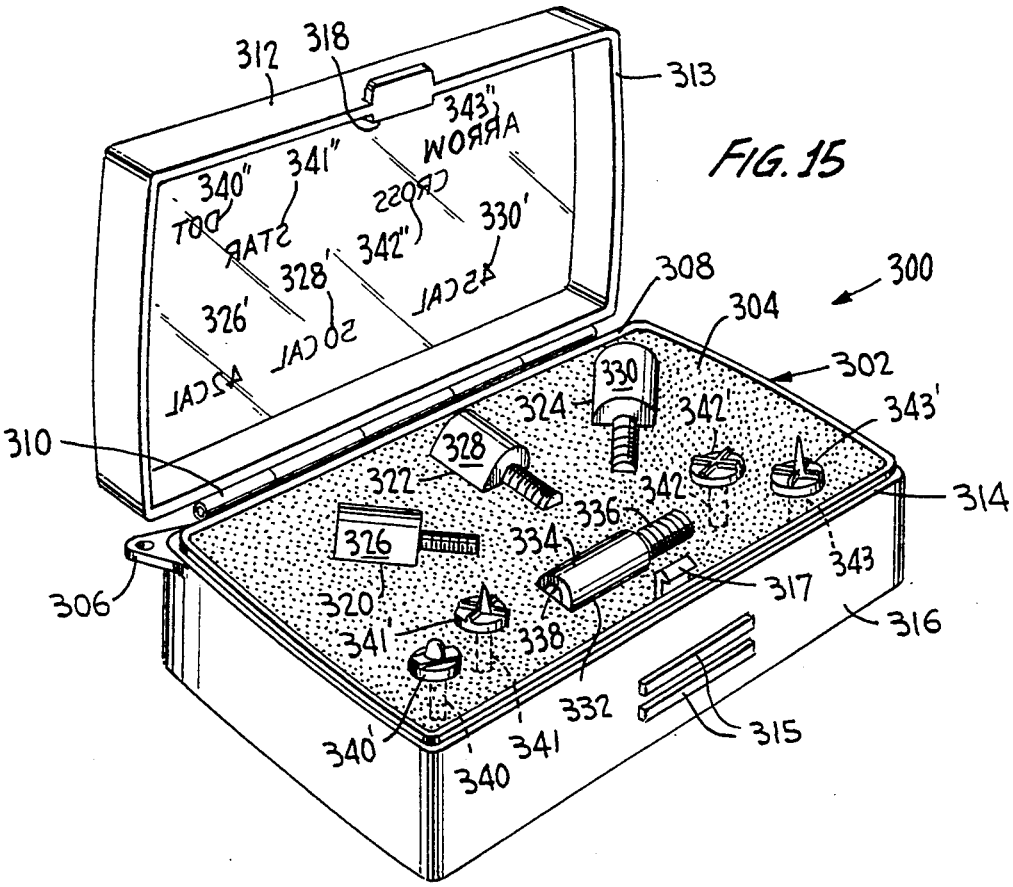
FIG. 15
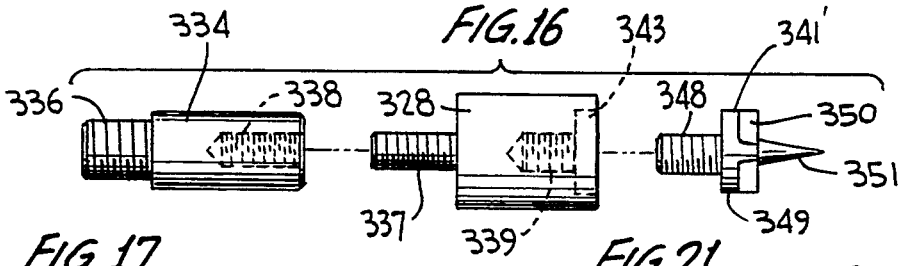
FIG. 16
FIG. 17
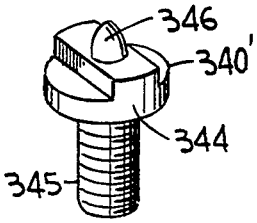
FIG. 18
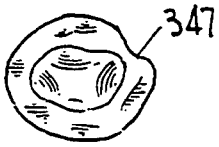
FIG. 21
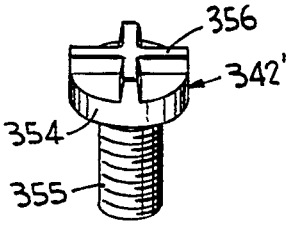
FIG. 22
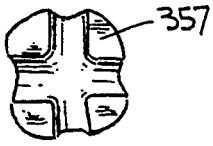
FIG. 19
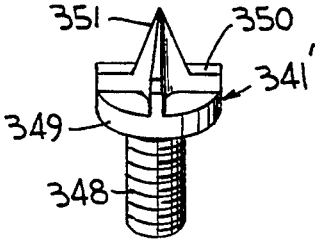
FIG. 20
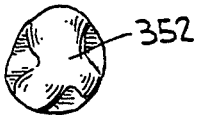
FIG. 23
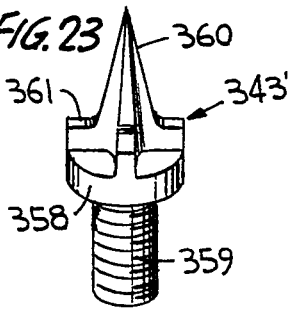
FIG. 24
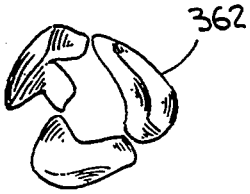

MUZZLE-LOADED EXPANDING PROJECTILES FOR FIREARMS; KITS FOR MANUALLY PRODUCING EXPANDING PROJECTILE FOR MUZZLE-LOADED FIREARMS; AND METHOD FOR PRODUCING EXPANDING MUZZLE-LOADED PROJECTILES

BACKGROUND

The present inventions relate to small arms ammunition and more particularly to hollow-point or hollow-nose projectiles usable in all types of small arms including revolvers, rifles, shotguns and the like.

Muzzle loading in early development of the USA was a way of life for settlers and hunters, and recently has made a comeback because of better control of charges, less expense, and the desire of the sportsperson to have hands-on control in the spot.

High energy transfer to the target, commonly described as "punch" or "knockdown power", coupled with controlled penetration, has in the past been achieved through "hollow point" configured projectiles or ammunition. Hollow point projectiles generally incorporate a centrally disposed, forwardly-opening axial recess which weakens the projectile at its nose and when striking the target, hydraulic and internal pressures build up within the projectile, causing the projectile to expand; upon striking the target, and provided unusual or great "punch" of "knock-down" power.

Muzzle-loading of firearms generally requires a loading rod, a centering "jag" comprising a machined, generally brass metal cylinder axially attached to the rod and having a terminal configuration generally conforming to the point or end of the projectile, bullet or "ball" introduced into barrel or bore of the firearm. Loading is accomplished by introducing a measured charge of gunpowder into a upwardly disposed firearm nozzle then inserting a patch (linen, cotton, etc.) and the projectile into the barrel on top of the patch. The rod, with the centering jag attached, is rammed into the gun barrel, against the projectile, etc., firmly seating the ball onto the patch and powder. Depending upon the type of firing mechanism, the firearm is recapped or primed, and is ready to be fired.

An example of an expansible bullet or projectile, is disclosed, for example, in the patent to Winchester U.S. Pat. No. 219,840 of Jul. 27, 1879. Here an expansive bullet is formed with a central, forward cavity across which longitudinal transverse slits are made by a saw, knife or slitting punch, and thereafter an axially directed compressing force is applied by a compressing die. This, of course, is not a projectile configured to have a hollow point or nose during loading.

Another hollow nosed projectile is the jacketed type as illustrated, for example, by the patent to Halverson U.S. Pat. No. 4,193,348. This too has a forward conical recess produced during manufacture.

SUMMARY OF THE INVENTION

The present invention comprises a novel assembly used to load a muzzle-loaded firearm in which the loading centering jag is modified to carry a selective, optional configuring die whereby, the projectile as it is being set in the muzzle of the firearm is simultaneously configured or embossed with different cross-sectioned conical recesses, each of which affording different expansive characteristics selectively optional during loading by the person loading the firearm.

Another object of the invention is to provide selective reconfiguration of a previously molded projectile, in particular, a spherical ball projectile, or conical projectile with a selected recess, whereby the projectiles are afforded an expansion feature when striking a target.

Another object of the invention is to provide a kit comprising a set of centering jags conforming to the caliber of different firearm barrels, and a set of configuring dies, each with a configuration different from the other, whereby the loader can optionally select the expansion or "punch" power of the projectile when loading a piece in the field.

Still another object of the invention is to provide a method of configuring a projectile during hand loading a pistol, rifle, shotgun or the like; or when bench loading ammunition during sizing or lubing of the ammunition.

Still another object of the invention is to provide sets of configuring dies mounted in an axially oriented trued position by means of a centering jag on the terminal end of a ram rod or the like, and in which, each of the dies have its own "punch" power characteristics, and which permit the loader to configure his bullets or projectiles according to the nature of the target.

BRIEF DESCRIPTION OF THE DRAWINGS

These together with other objects and advantages will become apparent from a consideration of the new inventions as disclosed in the specification appended hereto and as illustrated, by way of example only, by the drawing wherein:

FIG. 13 is a perspective view showing a bullet-sizer, in which the bullet is sized in a tube while simultaneously being configured with a conical configuring die whereafter the bullet can be moved and deposited in a circular passage to be collected in a suitable receptacle (not shown);

FIG. 14 is a fragmentary sectional view of FIG. 13 taken substantially on the plane of line 14—14 of FIG. 13; useable out in the field, incorporating a set of different-caliber configuring dies and centering jags as well as a coupling for adopting the centering jags to a ram rod or the like;

FIG. 15 is a perspective view of a configuring kit usable out in the field, incorporating a set of different-caliber or diameter configuring dies and centering jags, as well as a coupling for adopting the centering jags to a ram rod or the like;

FIG. 16, is an exploded elevational view of the coupling centering jag and a configuring die illustrating how they are assembled in longitudinal, operative alignment for receipt on a ram rod during muzzle loading of a firearm;

FIG. 17 is a perspective view of one of the configuring dies of the kit of FIG. 15;

FIG. 18 is a plan view of a projectile, after engaging a target and penetrating the same, in which the projectile initially comprised a spherical ball element, configured with a recess with the die of FIG. 17;

FIG. 19 is another embodiment of the projectile configuring die of the kit of FIG. 16 in which a central multi-finned nose has radial ribs extending from each fin; the fins having a rectangular cross-section;

FIG. 20 illustrates the configuration of a spherical ball-type projectile after striking a target and penetrating a target after having been configured with a die as shown in FIG. 19;

FIG. 21 is a perspective view of still another configuring die comprising a cross-shaped configuration;

FIG. 22 illustrates the configuration of a ball-type projectile after having been configured by the die of FIG. 21 and penetrating a target;

FIG. 23 is a perspective view of still another configuring die, in which the function is similar to that of the die of FIG. 19, but is of larger size; and FIG. 24 illustrates the shape of a configured, ball-type projectile inscribed with the die of FIG. 23 after having penetrated a target.

DETAILED DESCRIPTION

Figures 1, 2, 3A, 3B, 3C, 3D, 4A, 4B, 5A, 5B, 6A, 6B, 7A, 7B, 8A, 8B:
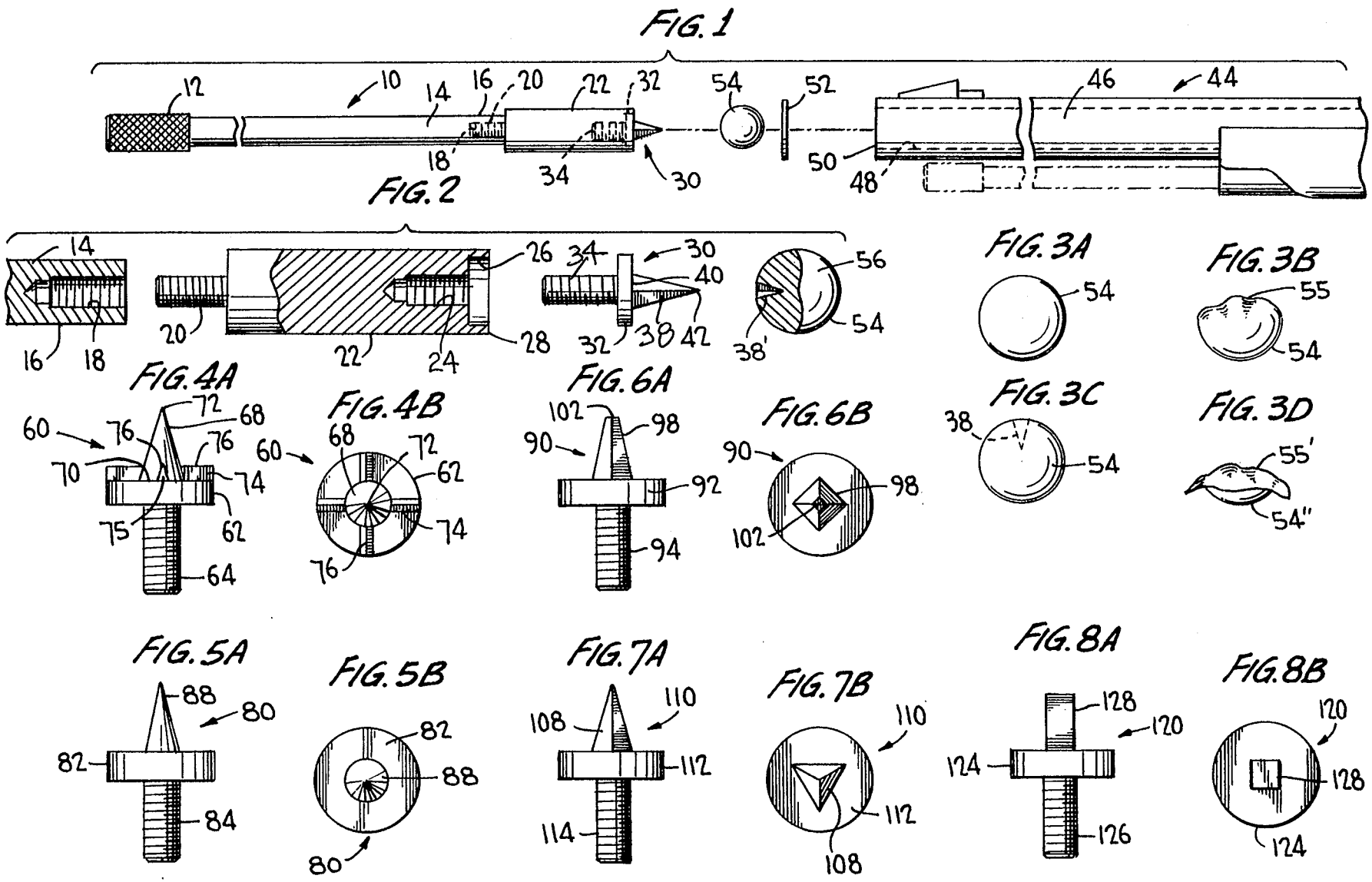
FIG. 1 is an exploded side elevational view, showing a ram rod, with a centering jag and configuring die mounted thereon, together with a ball-projectile, patch and a fragmentary portion of a barrel of a muzzle-load weapon.
FIG. 2 is an enlarged, side elevational view of FIG. 1, with portions broken away to show construction details of the rod end, centering jag and configuring die in relation to the ball in which an expanding recess has been formed in the ball.
FIG. 3A is a side elevational view of spherical ball-type projectile without an expanding recess formed therein.
FIG. 3B is a view similar to FIG. 3A showing the projectile after it has struck a typical target during optimum penetration.
FIG. 3C in a view similar to FIG. 3A with the spherical ball-type projectile having a conical recess formed therein.
FIG. 3D is a view similar to FIG. 3B showing the projectile of FIG. 3C after it has struck a target during optimum penetration, and illustrating the more flatten character of the projectile with its commensurate "punch" power.
FIG. 4A is an elevational view of another embodiment of a configuring die incorporating a conical central portion with a plurality of chisel ribs radiating from the base of the conical central portion.
FIG. 4B is a plan view of the die of FIG. 4A looking toward the conical central portion thereof.
FIG. 5A is an elevational view of another embodiment of the configuring die in which the radial chisel ribs of FIGS. 4A & 4B have been eliminated.
FIG. 5B is a plan view of FIG. 5A looking toward the central conical portion thereof.
FIG. 6A is a view similar to FIG. 5A, comprising an elevational view, without radial chisel ribs in which the central axial, configuring portion comprises a truncated, rectangular-cross-sectioned pyramid.
FIG. 6B is a plan view of FIG. 6A looking down onto the truncated, rectangular-cross-sectioned configuring portion.
FIG. 7A is a view similar to FIG. 6A in which the axial configuring portion comprises a triangular pyramidal portion.
FIG. 7B is a plan view of FIG. 7A looking onto the triangular pyramidal portion.
FIG. 8A is a view similar to FIG. 6A in which the axial, central configuring portion is a rectangular-cross-sectioned element.
FIG. 8B is a plan view of FIG. 8A looking toward the end of the rectangular-cross-sectioned element.

As illustrated in FIGS. 1 and 2, an elongated ram rod is indicated at 10 and comprises a handle 12 integral with a shaft 14 having an axial, internally-threaded or tapped terminal end portion 16. The threaded portion 18 will receive a complimentary threaded portion 20 of a centering jag 22. The centering jag(s) will be of varying diameters or calibers mating with the caliber of the barrel of the various firearms, e.g. the centering jag used with a 0.22 caliber rifle or revolver will be different than the diameter of a 0.45 caliber pistol.

The centering jag 22 is modified at the end opposite the threaded stud 20 having an internally threaded bore 24 normal or at right angles to a cylindrical recess 26. The ram rod will be produced from any suitable material, however, the centering jag 22 is carefully machined from brass or the like, since its forward peripheral edge 28 is to conform to the caliber or barrel diameter of the firearm.

A configuring die, also machined from a suitable material such as hardened steel or the like, is indicated generally at 30 and comprises a medial, cylindrical land 32 conforming substantially to the area of the centering jag recess 26; and projecting axially and normal to the land 32 is a relatively long, threaded stud 34. The stud will be hand-screwed into the threaded centering jag recess 26 and is extremely stable therein because of the relative large stud 34 and the land conforming to the cylindrical recess 26. The configuring die 30 has integrally formed thereon, and projecting axially and forwardly therefrom, i.e. opposite the threaded stud 34, is an embossing or inscribing die portion 38, which in this instance comprises a four-sided pyramid; affording a relatively large and stable base 40, and a sharp terminal point 42.

Referring to FIG. 1, a fragmentary portion of a muzzle-loaded firearm is indicated generally at 44 and may comprise a rifle, shot gun, pistol etc. The firearm 44 includes a barrel 46 having a bore 48 which may be any one of the conventional sizes, i.e. 0.22 caliber, 0.30 caliber etc.

Assuming the barrel is in condition to receive a charge, a measured charge of suitable black gun powder, or the like is poured into the gun bore 48 at end 50. Next, a patch 52, generally of cotton or linen, has a projectile 54 placed thereon, and they are inserted into the bore 48 of the barrel 46. The ramrod 10, with the centering jag 22 and configuring die 30, assembled thereon (as seen in FIG. 1), is inserted into the barrel 48, and the projectile 54 and patch 52 are rammed into the bore of the firearm, firmly compacting the gunpowder. The configuring die, i.e. portion 38, 40, 42, will emboss or inscribe a recess 38′ in the projectile 54; see broken away portion in FIG. 2. The ball will thus have formed therein, when loading, a recess 38' complimentary or the mirror image of conforming die end 38.

Additionally, the spherical ball shown will have its uninscribed rear portion 56 slightly heavier because it has no conical indent or recess formed therein. When the projectile is fired, the ball will tend to fly with the indent-forward; this being the normal characteristic of flight. Upon striking a target, such as an animal, the relatively soft tissue engaged and compressed in the indent or embossment 38 will cause hydraulic pressure to build up causing the projectile to expand or mushroom, as seen, for example in FIG. 3D.

As seen in FIG. 3A, a spherical projectile or ball is indicated at 54, and when this completely spherical ball penetrates a target, the striking end is mashed or deformed as indicated at 55, while the trailing end 54 remains substantially semi-spherical. However, as shown in FIGS. 2 and 3C, the projectile 54 is configured with the conical, pyramidal recess 38', when striking a target comprising animal tissue, or the like, a tremendous hydraulic or hydrostatic pressure builds up within the projectile 54 and in indentation 38, resulting in the projectile, generally of soft lead or an alloy, substantially flattening out as indicated at 55', while the rear of trailing end 54 still remains semi-spherical. This results in a larger striking area at 55', and greater "punch" or striking power is afforded by the ball conformed with the reconforming die 30 during loading of the muzzle-loaded firearm.

As it will be appreciated, a unique method of forming muzzle loaded projectiles into those which are expansible or mushroom as seen in FIG. 3D. As the powder charge is rammed, or the ball is firmly seated using the ram rod and centering jag, it is simultaneously conformed with an expandable recess providing a projectile having increased punch power without increasing the gun powder charge. Further the flight or aerodynamic characteristics are not impaired, but to the contrary are improved, since the heaviest end is rearward (when leaving the barrel) thus affording a projectile with greater punch-power, and one with true flight characteristics.

Modifications of the configuring dies are contemplated within the scope of the invention, and these differently formed dies will provide different flight and impact characteristics to the projectiles. As will subsequently become apparent, a set of configuring dies will be incorporated in a kit, comprising different configuring dies, different sized centering jags, and an adapter for connection to a ram rod.

For example, in FIG. 4A, on a slightly enlarged scale, a reconfiguring die is indicated generally at 60 and it comprises a medial cylindrical land 62 which has an integral, threaded stud 64 and these portions are essentially the same size as those of the comparable portions of the die 30, and the stud 64 and cylindrical land 62 will engage in the threaded end 24 and the recess 26, respectively, of the centering jag 22.

The forward end of the reconfiguring die includes a central or axial pointed conical portion 68 which has a terminal point 72 and a relatively large, stable circular base 70. Formed integral with the upper surface of the circular land 62 are four chisel-ribs 74 which are triangular in cross-section (see FIG. 4A), and have a broad base 75 and an upper sharp edge 76. The ribs will inscribe slits in a crusiform radiating from the base of a conical recess on a projectile being inscribed.

Referring to FIG. 3D, it will be noted the mushroom shape of the striking projectile. When utilizing a reconfiguring die as shown if FIGS. 4A, 4B, the projectile will tend to spread to a greater striking area because of the cruciform indents or slits formed by ribs 74.

In FIGS. 5A, 5B, another reconfiguring die is shown. This die incorporates a lower threaded stud 84 and an intermediate cylindrical land 82 functioning as do the corresponding parts of the dies of FIGS. 1, 2, 4A and 4B. The central, forward indent-forming portion comprises to cone 88, which causes still another type of mushrooming in a projectile which is reconfigured thereby. For example, using the die 80 of FIG. 5A, 5B, the mushrooming will be slightly less than that shown in FIG. 3D, since the die used to produce the configuration of FIG. 3D is pyramidal, and formed rupture planes, which the indent formed by the die of FIGS. 5A, 5B does not incorporate sharp internal rupture lines or panels.

In FIGS. 6A, 6B there is shown a die 90 having a medial, cylindrical land 92, and lower threaded stud and an upper indenting or inscribing portion 98. Of course, the threaded stud and land of this embodiment functions as do the comparable parts of the previously described embodiments. However, the inscribing or reconfiguring portion has a blunt, planar end, i.e. the portion 98 is frusto-pyramidal. Here, too, a different impact configuration is formed, i.e., the squared end 102 forms a rectangular plane within the projectile being inscribed. The internal hydraulic or hydrostatic pressures, due to different weakened lines, will cause still greater mushrooming of the striking projectile than that shown in FIG. 3D.

In FIGS. 7A, 7B still another reconfiguring die is indicated generally at 110. The usual medial, cylindrical land 112 has depending axially therefrom an integral threaded stud 114. Projecting axially from the medial land 112 is a reconfiguring embossing or inscribing end 108, comprising a pointed, triangular pyramid, which will form a mirror image recess, centrally of a projectile or bullet being inscribed. The recess being inscribed will cause greater mushrooming than the plain cone 88.

Referring to FIGS. 8A, 8B, still another embodiment of the configuring die is indicated generally at 120, comprising a medial, cylindrical land 124 and an integral, threaded stud 126. Projecting axially and opposite the threaded stud 126, is a rectangular, inscribing or embossing die 128 which will cause a still different type of mushrooming of the striking projectile.

The projectile variations permit the loader to select different types of expansion characteristics in muzzle-loaded firearms, and this with variations in the powder load, enable the sportsperson to have a variety of "punch" capabilities available to him in the field when hunting.

The various types of configuring dies illustrated in FIGS. 2–8B can be utilized with a muzzle-loading a pistol, rifle or shot gun.

Figure 9:
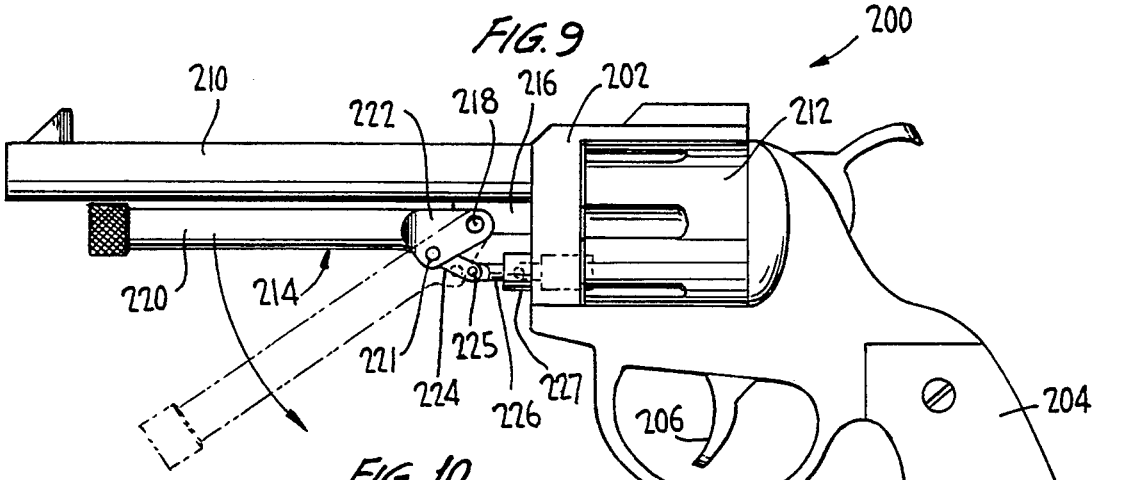
FIG. 9 is a side elevational view of a muzzle loading pistol incorporating a muzzle loading assembly.
Figure 10:
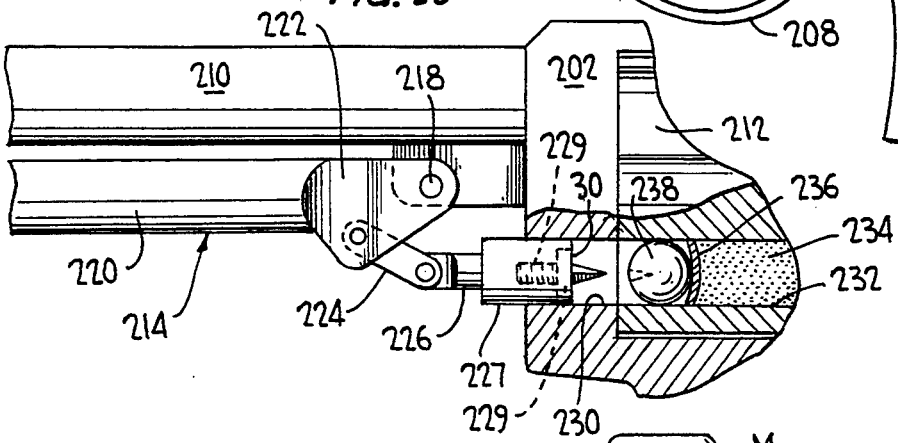
FIG. 10 is a fragmentary elevational view of FIG. 9, with portions broken away to show how the configuring die is mounted on the pistol ram-rod, and showing a ball and patch to be rammed onto a previously measured powder-charge.

In FIG. 9, a muzzle-loaded revolver is illustrated generally at 200, including a frame 202 integral with a handle 204, trigger 206, trigger guard 208, barrel 210, and a cylinder or rotary firing chamber 212. The cylinder of the chamber is rotatable each time the weapon is cocked and/or fired and this results in a firing chamber being aligned with the rear end of the barrel 210. The mechanisms mentioned heretofore are all conventional. The revolver 200 includes a loading mechanism 214 comprising a mounting block 216 to which is pivoted at 218 a loading lever 220. Pivoted at 221 on a flattened toggle-plate 222, formed on the rear portion of the loading lever 220, is a toggle lever 224 pivotally connected at 225 to a rod mounting portion 226 integral with a centering jag 227. The centering jag 227, at its forward end, has an internally threaded bore 229 accommodating the threaded shaft of one of a variety of configuring dies FIGS. 2–8B as previously described. The configuring die threaded onto the centering jag 227 (see FIG. 10) will rest in an aperture 230 formed in the revolver frame. This aperture being alignable with one of the chambers 232 of the cylinder 212.

The pistol or revolver is loaded through the chambers 232 in the cylinder, by first introducing a measured load of black powder 234. Then a wad 236 is inserted with a spherical projectile or ball 238; all five or six chambers of the cylinder are loaded with a charge of powder, wad and ball-projectile.

After the charges are introduced in the firing chambers of the rotatable cylinder, the loading mechanism 214 is pivoted downwardly as shown by dotted lines in FIG. 9; at which time the toggle lever 224 is forced toward the right and configuring die 30, 60, 80, 90, 110 or 120 will be driven into engagement with the projectile 238, forming therein a forwardly opening cavity complimentary to the embossing end of the selected die. This procedure will be repeated for all of the chambers of the rotatable cylinder 212. Thus, the revolver 200 will have loads all containing a mushrooming projectile.

It will be observed that the toggle lever 220 together with the centering jag 227 and die 229 correspond in function to the ram rod 14, centering jag 22 and die 30 of the embodiment previously described and disclosed in FIG. 1. The rod 226, centering jag 227 and die 30 thereon, are urged axially through aperture 230 into contact with the ball 238, embossing or reconfiguring the projectile with the conical recess 238 while compacting the powder 234 beneath the wad 236. Thus, as in the embodiment of FIG. 1, the rod, centering jag, die combination performs a dual function of reconfiguring or embossing the ball as the charge is compacted.

Figure 11:
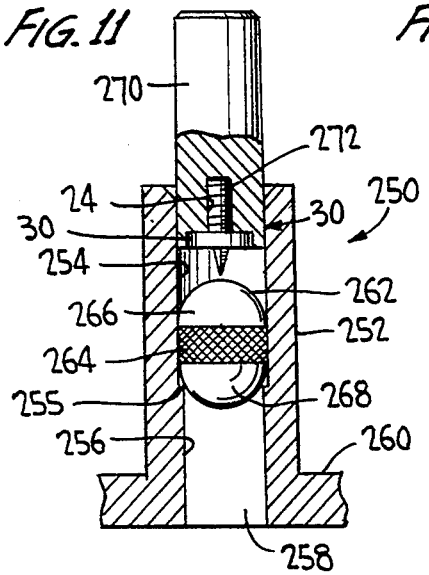
FIG. 11 is a side elevational view, with portions broken away of a sizing tube, in which one end of a projectile having a double-ended ogival form in which a forming punch incorporates a conforming die in a position to form an axial recess in the adjacent end of one of the ogives.
Figure 12:
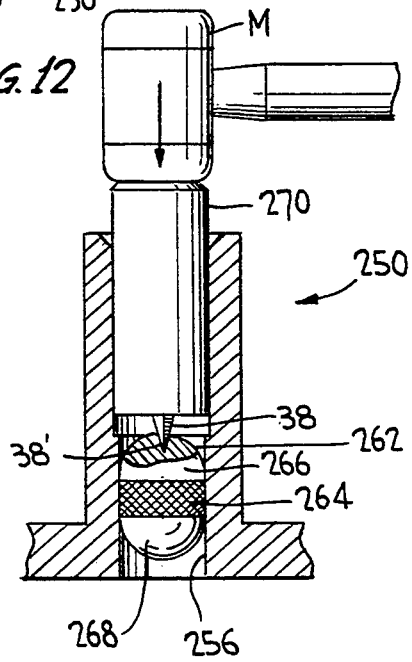
FIG. 12 is a view similar to FIG. 11, showing the central band of the projectile of FIG. 11 being sized; i.e. forced through the sizing tube, while at the same time axial forces form a conical recess of the projectile.

Referring to FIGS. 11 and 12, a projectile luber/sizer is indicated generally at 250 comprising a sizing tube 252 including an upper bore 254, communicating with a lower sizing bore 256, i.e. 0.45 caliber, for example, which has an open lower end 258 and a support flange 260 about the lower open end. The flange will rest on a suitable receptacle, not shown.

A projectile is indicated at 262, in this instance comprising a dual-end or multiple-ogival molded projectile having a central, knurled portion 264 integral with ogival ends 266 and 268, i.e. the projectile is symmetrical about a medial plane extending centrally, and at right angles to the projectile knurled portion 264. The knurled portion 264 will accumulate, in its intercies, a suitable lubricant which facilitates friction-reduction in the bore of the firearm in which the projectile is fired.

When the projectile 262 is seated on a shoulder 255, formed between the bores 264 and 256, the lower end 268 will extend beneath the shoulder 255. A punch 270, conforming to the diameter 254, and slidable therein, has a lower tapped bore 272; threadly receiving the threaded stud 24 of configuring die 30; or the threaded stud of any of the dies shown in FIGS. 2–8B.

As seen in FIG. 12, the configuring end 38 of the die 30, will penetrate the projectile end 266, forming therein, a conical recess 38′ when the punch 270 drives the projectile i.e. double-ogival bullet or conical bullet through the sizing bore 256.

In FIGS. 13 and 14, a sizing tube is indicated at 280 being integrally mounted on a support plate 282 and pivotal on a support plate or mandrel 284, which has an aperture 290 in the path of pivotal movement of the bore, 286 of the sizing tube 280 (see FIG. 14). A centering jag element or punch 288 has an internally threaded bore in its lower end and receives therein the reconfiguring die 30 having a terminal pointed end 38. This punch 288 is placed in the bore 286 on top of an ogival-ended bullet 154′ which has been inserted therein and which rests in a curved seat 285 in the plate or mandrel 282.

After the die 30 and its point 38 is forced onto the projectile 154′, a conical fracture is formed. The centering jag or punch 288 is withdrawn, and the plate 282 is pivoted across the surface or support plate 284 until the bore 286 (and bullet 154′ therein) align over a hole 290 in the mandrel plate 284, and the projectile or bullet drops into a suitable container beneath the hole 290.

Referring to FIG. 15, a kit is indicated generally at 300, preferably comprising a case 302 molded from a transparent plastic and containing therein a resilient sponge-like block 304 conforming to the interior of the case. The block 304 is produced from a colored material such as orange or red, which will be discernable if dropped in the field, and is preferably reflective so that, if lost in the field, it can be readily relocated. The case has an integral eyelet portion 306 to which a lanyard or the like can be attached to prevent loss in the field and to make the kit readily accessible to a person muzzle-loading in the field.

Hinged along a suitable hinge (extending substantially the length of the back 308 of the case), is a hinge assembly 310 to which a transparent cover 312 is hinged. The case has an upper peripheral lip 313 which is received in a peripheral recess 314 which receives the lip 313 therein when the lid engages on the case and the case is closed. The case has a plurality of ribs 315 on its forward wall 316 and an upwardly extending latch 317 which engages beneath and upper, inwardly projecting lip 318 for retaining the case closed. The lid, case and recess assist to maintain the contents or kit dry. Since the kit is used out in the field, it is a stable, dry, well constructed case that will not accidentally open to lose its contents.

The upper surface of the block 304 contains generally rectangular recesses 320, 322, 324 which will respectively, removably receive therein a centering jag 326, 328 and 330 which will have a diameter corresponding to 0.54 caliber, 0.50 caliber and 0.45 caliber weapon barrels. The lid or cover 312 has on its upper surface indicia 326′, 328′, and 330′ which reads: "0.42 Cal.", "0.50 Cal." and "0.45 Cal." overlying the respective centering jags and facilitating the optional selection by the person effecting muzzle-loading. The jags, as will be described, each include a threaded stud portion extending axially from one end, which an internally threaded axial recess, surrounded by an undercut cylindrical recess.

Also provided in the upper surface of the block 304 is a rectangular recess 332 which receives therein an adapter 334 comprising an axial threaded stud 336 at one end, and an axial threaded bore 338 at the other end. The adapter 334 will connect its threaded stud to a cleaning rod 14, as shown in FIG. 1, or to any other weapon cleaning or loading rod or tool.

The block also has formed therein four cylindrical recesses 340, 341, 342 and 343 which respectively receive therein the threaded, mounting studs at the rear portion of a reconfiguring die 340', 341', 342', and 343', which are arbitrarily identified as "DOT", "STAR", "CROSS" and "ARROW", respectively. In alignment with the respective configuring dies 340'–343', is indicia 340'', 341'', 342'' and 343'' which are visible through the upper surface of the case lid 312 and which are respectively in alignment with the "DOT", "STAR", "CROSS" and "ARROW" configuring dies.

The die 340' "DOT" comprises a cylindrical base 344 integral with an axial threaded stud 345 and projecting axially away from the stud, is a dome-shaped configuring die portion 346; as seen in FIG. 17. This die,, as well as the others to be described, can be used to emboss or reconfigure a projectile, i.e. spherical, or double ogival. In FIG. 18, a spherical (ball) 347 having been embossed with the "DOT" die, has a flattened shape, when striking a target, affords greater punch-power than a conventional spherical projectile as seen in FIG. 3B, for example.

The die 341' "STAR" has an axial mounting stud 348 integral with a medial, cylindrical orienting portion 349 from which projects four cross-shaped arms 350 radiating from an axial point or cone 351. Referring to FIG. 20, the "STAR" die 341' affords still another shaped projectile 352, since the cross-shaped arms and point or cone, provide a deeper recess in a projectile than does the dome-shaped portion 346 of die 341', for example.

The die 342' "CROSS" includes a medical cylindrical portion 354 which has integrally formed therewith an axial, threaded mounting stud 355, extending in one direction, and having formed the upper surface thereof, a cross-shaped configuration 356, in which the arms thereof have a rectangular cross-section. The cross-shaped portion 356, when reconfiguring a spherical ball projectile, will provide still another flattened configuration to the striking projectile when striking a target, as shown in FIG. 22 at 357. This projectile, through the relatively flat embossing made by the cross-shaped portion 356, will provide a still different flattened striking-shape resulting in still another punch-power characteristic.

The die 343' "ARROW" has a medial cylindrical portion 358 having projecting axially from one side an integral, externally threaded mounting stud 359 and projecting axially from the other side is a relatively long arrow point 360 having radiating from its base cross-arranged arms 361. The arms 361 have a rectangular cross-section. The reconfiguring die portion of the "ARROW" embodiment, forms a relatively deep cone in the projectile being reconfigured, and the cone has radiating therefrom, a cross-shaped groove, thus affording still another shaped impact-slug 362 as shown in FIG. 24. This projectile of FIG. 24 has a relatively great flattened configuration, as compared with FIGS. 18, 20 and 23, and thus affords still greater "punch" power.

Referring to FIG. 16, the adaptor 334 is connected to the centering jag 328, for example. The threaded stud 337 of the centering jag was hand-threaded into the threaded recess or bore 338 of the adaptor. The centering jags (all of them) have an internal threaded bore 339 surrounded at its open end by a cylindrical seat 343. This threaded bore and cylindrical seat, assure that the medial cylindrical portion of each of the dies 340', 341', 342' and 343' are optimally oriented on the end of the centering jag(s) through torque applied by finger-power.

The sealed lips and grooves, as well as the piano hinge of the kit-case 302 maintains minimal moisture and exposure to air. The centering jags, adaptor, and dies are machine produced from brass (i.e., centering jags and adaptor) and machine steel in the case of the dies.

The kit affords a versatility to the hunter or marksman that was never heretofore available. He has a kit available for modifying 0.45, 0.50 and 0.54 caliber projectiles in the field, as well as selecting what amount of "punch-power" he need, depending upon the nature of his target. For example, when hunting bear, a 0.54 caliber projectile might be the most efficient, while when hunting wolf, a 0.45 caliber projectile would be most efficient.

Likewise, the marksman, simultaneously when loading and packing the charge, configures the projectile. Thus it requires but a single procedure to accomplish two options, i.e. a load and simultaneous selection of increased punch power.

Obviously, many modifications and/or variations of the present inventions are possible within the scope of the above disclosures and teachings. It is therefore understood that within the scope of the appended claims, the inventions may be practiced otherwise than as specifically described.

What is claimed is:

1. In a muzzle-loading system for weapons, comprising barrel means for receiving, serially, a powder charge means, patch means, and projectile means, and ram-rod means for tamping the charge, the improvement wherein said ram-rod means includes centering jag means at one end of the ram-rod means, said centering jag means having a diameter corresponding to the caliber of the weapon being loaded and being slightly under bore diameter, and a configuring die means on the terminal end of the centering jag means for forming a desired configuration in the projectile means simultaneously as the charge is tamped whereby a newly configured projectile is provided.

2. In the system as defined in claim 1, in which said centering jag means comprises one of a set of centering jag means, the set of centering jag means comprising one of a plurality of centering jag elements each having a different diameter that is slightly under bore diameter to allow movement freely through the bore of the weapon.

3. In the system as claimed in claim 1, in which said centering jag means and die means, respectively, include a threaded stud portion for removable connection to said ram-rod means and to each other.

4. In the system as claimed in claim 1, in which said centering jag means comprises an internally threaded axial bore terminating in an annular seat opening into the end of said centering jag means, said die means comprising an axial, externally threaded stud at one end integral with a medial, annular element conforming to and removably seated in said annular seat of said centering jag means, the die means including an axial embossing portion comprising a terminal projection for forming a cavity in the projectile means and providing a mushrooming projectile when striking a target.

5. In the system as claimed in claim 4, in which said axial embossing portion terminal projection has a convergent end.

6. In the system as claimed in claim 5, in which said convergent end is dome-shaped in elevation.

7. In the system as claimed in claim 5, in which said axial embossing portion terminal projection terminates in a point.

8. In the system as claimed in claim 7, in which said terminal projection is conical in elevation and has a circular cross section.

9. In the system as claimed in claim 8 in which said terminal projection has radial ribs projecting from the base of the projection which is conical in elevation.

10. In the system as claimed in claim 7, in which said terminal projection is pyramidal in elevation.

11. In the system as claimed in claim 10, in which the terminal end of said projection is a flat plane.

12. In the system as claimed in claim 10, in which said terminal projection has a triangular cross-section.

13. In the system as claimed in claim 10, in which said terminal projection has a rectangular cross-section.

14. In the system as claimed in claim 10, in which said terminal projection is rectangular in elevation and has a rectangular cross-section.

15. In the system as claimed in claim 1, in which said projectile is spherical.

16. In the system as claimed in claim 1, in which said projectile is elongated and has a double ogival configuration in which opposite ends thereof are hemispherical.

17. In the system as claimed in claim 16, in which said projectile has an intermediate knurled circumferential band between said hemispherical opposite ends.

18. A projectile for use in a muzzle-loading system for weapons, said projectile comprising malleable material, said projectile being spherical, the spherical projectile having an embossed configuration whereby the projectile flys with the embossed configuration forward, and the projectile is of the hollow-nose type.

19. A projectile for use in a muzzle-loading system for weapons, said projectile comprising a double-ended ogive in which one end has an embossed configuration whereby said projectile flys embossed-end forward, and the projectile is of the hollow-nosed type.

20. In the muzzle-loading system as claimed in claim 1, in which said weapon comprises a revolver having a cylinder for containing a plurality of charges, said ramrod means comprising a toggle-linkage in which said centering jag means in disposed in a cylinder bore of the revolver frame, each of the cylinder charges being alignable with said centering jag means whereby each charge contained in the cylinder can be individually tamped and the projectile can be reconfigured with a mushrooming indentation for producing a hollow-nosed projectile.

21. A sizing apparatus for projectiles, comprising in combination a tubular sleeve having a lower diameter corresponding to the caliber of the projectile to be sized, said sleeve having an upper diameter corresponding to the diameter of an unsized projectile and forming an annular seat with said lower diameter for supporting thereon an unsized projectile, punch means removably received in said tubular sleeve and having a diameter corresponding to that of the upper diameter of the sleeve and reciprocal therein down to the annular seat, said punch means having an internally-threaded, axial bore terminating in an annular seat, and configuring die means including a threaded stud removably received in said internally threaded bore of said punch means, said threaded stud of the die means being integral with a medial, annular collar, removably received in the annular seat of the punch means for orienting the die means axially, said die means terminating in a terminal embossing portion whereby a projectile seated on the annular seat of said tubular sleeve can be forced beyond said sleeve seat and be sized while the projectile is simultaneously configured by said terminal embossing portion so that the projectile is sized and configured into an expandable mushroom projectile when axially sizing force is provided on the upper end of said punch means.

22. A sizing apparatus as claimed in claim 21, in which said tubular sleeve is mounted on a pivot axis on a support carried-on a support member, said support member having an aperture alignable with the lower end of said sizing sleeve whereby projectiles sized and configured can fall through said aperture.

23. The method of muzzle-loading weapons for producing hollow pointed projectiles and compacting the weapon charge comprising:

depositing, in sequence, a powder charge means, patch means, and projectile means in the barrel of a weapon;

providing ram means for compacting the weapon charge, providing said ram means with centering jag means including a terminal configuring die including one of a selected group of configuring terminal ends for effecting a hollow recess in the projectile of the weapon charge; and simultaneously tamping the weapon charge and forming a hollow-nose projectile through the application of tamping pressure.

24. The method as claimed in claim 23, including the step of forming the charge using a spherical projectile.

25. The method as claimed in claim 23 including the step of forming the charge using a double ogival projectile.

26. A muzzle-loading kit for providing optional caliber tamping and simultaneous production of a hollow-point projectile, comprising in combination case means and hinged lid means having a hinge assembly at one side and latch means opposite said hinge means; and a resilient block in said case means, said block having recess portion corresponding to and supporting one of a plurality of optionally selectable components of a muzzle-loading assembly including at least one centering jag means, one coupling means for connection to a ram rod, and one configuring die means whereby the centering jag means, coupling means and configuring die means can be assembled in the field and a muzzle-loaded weapon can be loaded, tamped and reconfigured into a hollow-point, charged weapon while the charge is tamped.

27. A muzzle-loading kit as claimed in claim 26 in which said kit includes a plurality of centering jag elements, each having a different diameter and corresponding to a different weapon caliber, each of the centering jag elements having a threaded stud for removable engagement with the coupling or ram rod means, said centering jag elements having an internally threaded, axial bore at the end opposite said internally threaded bore, and an annular recess surrounding the internally threaded bore of said centering jag elements, said die means comprising a plurality different configuring dies each affording a different effective punch characteristic to a weapon projectile, said configuring dies each having a threaded stud for removable receipt in the internally threaded bore of said centering jag elements, said configuring dies each having a medial collar conforming to the shape of the annular recess of said centering jag elements for orienting the configuring dies into axial alignment, each of said configuring dies having a terminal, embossing portion for inscribing a hollow recess in a weapon projectile of a muzzle-loaded weapon as its charge is tamped.

28. The muzzle-loading kit as claimed in claim 27, in which the terminal embossing portion of one of said dies is dome-shaped.

29. The muzzle-loading kit as claimed in claim 27, in which said terminal embossing portion of one of said dies comprises a conical point, including radial base arms continuing into said conical point.

30. The muzzle-loading kit as claimed in claim 27, in which the terminal embossing portion of one of said dies is cross-shaped.

31. The muzzle-loading kit as claimed in claim 26, in which said case and lid include meshing rib and groove portions for sealing the contents of said kit and maintaining the case and lid securely closed.

32. The muzzle-loading kit as claimed in claim 26 in which said case includes and integral eyelet portion for accommodating a lanyard or the like.

33. The muzzle-loading kit as claimed in claim 26, in which said lid is transparent so the contents of the kit can be readily viewed, said lid including indicia means corresponding to, aligned with, and describing each of the components contained in the kit whereby selection and identification of each of the components can be readily identified for enabling the user to readily select an optional combination in the field, enabling the user to readily ascertain the caliber size and impact characteristics of the projectile in relation to the user's target and needs.

34. In the system as claimed in claim 1 in which said projectile has at least one ogival end portion.

35. The method as claimed in claim 23 including the step of forming the charge using a single ogival projectile.

36. In a muzzle-loading system for weapons comprising barrel means for receiving serially, a powder charge, patch means, and projectile means, and ram-rod means for tamping the charge, the improvement wherein said ram-rod means includes attaching means at one end of the ram-rod means, and configuring die means removably secured to said attaching means for forming a desired configuration in the projectile means simultaneously as the charge is tamped whereby a newly configured projectile is provided.

37. In the system as claimed in claim 36, in which said configuring die means and said ram rod means each including respective threaded stud and bore portions for affording the removable securement between said ram-rod means and said die means.

38. In the system as claimed in claim 37, in which said die means includes a terminal projection for effecting a cavity in the projectile means and providing a hollow-nose projectile which mushrooms when striking a target,

39. In the system as claimed in claim 38, in which said terminal projection is reduced in diameter and has a circular cross section.

* * * * *